US006672660B2

(12) United States Patent
Hoshino

(10) Patent No.: US 6,672,660 B2
(45) Date of Patent: Jan. 6, 2004

(54) CHAIR FOR A DRUM

(75) Inventor: Yoshihiro Hoshino, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 56 days.

(21) Appl. No.: 10/038,382

(22) Filed: Oct. 24, 2001

(65) Prior Publication Data

US 2002/0163231 A1 Nov. 7, 2002

(30) Foreign Application Priority Data

May 2, 2001 (JP) ..... 2001-135273

(51) Int. Cl.[7] ..... B60N 2/38

(52) U.S. Cl. ..... 297/195.1; 297/423.41; 297/461; 297/202; 297/195.11; 248/177.1; 248/188.5

(58) Field of Search ..... 297/195.1, 461, 297/452.2, 202, 195.11, 311, 423.41, 423.45, 344.12, 201, 215.1, 215.11, 214; 248/177.1, 188.5

(56) References Cited

U.S. PATENT DOCUMENTS 4,183,579 A * 1/1980 Gonzalez y. Rojas .. 297/195.11
4,607,882 A * 8/1986 Opsvik ..... 297/195.11
4,932,719 A * 6/1990 Gonzalez y. Rojas ..... 297/338
5,738,326 A * 4/1998 Liao ..... 248/405
6,030,045 A * 2/2000 Hoshino ..... 297/461
6,045,193 A * 4/2000 Johnson ..... 297/423.41
6,079,775 A * 6/2000 Lawson ..... 297/215.14
6,152,524 A * 11/2000 Cox ..... 297/201
6,193,309 B1 * 2/2001 Gootter et al. ..... 297/202
6,254,180 B1 * 7/2001 Nelson ..... 297/201
6,450,572 B1 * 9/2002 Kuipers ..... 297/195.1

* cited by examiner

*Primary Examiner*—Peter M. Cuomo
*Assistant Examiner*—Erika Garrett
(74) *Attorney, Agent, or Firm*—Ostrolenk, Faber, Gerb & Soffen, LLP

(57) ABSTRACT

A chair having a seat plate supported by legs, the seat plate having a top side with two concaves therein below where a seated person's hip bones project and optionally an additional concave rearward of the two concaves and below where the seated person's coccyx projects. The positions of the concaves are selected to be where a performer on a drum is likely to be seated when playing a drum while seated. The two concaves may be circular or may be elongated in the forward-rearward direction. The seat plate may be circular or it may be a bicycle seat shaped with downward and outward sloping concaves for the femoral thigh regions at the sides and toward the front.

15 Claims, 9 Drawing Sheets

CHAIR FOR A DRUM

BACKGROUND OF THE INVENTION

The present invention relates to a drum chair used by a performer when playing a drum.

A drum chair used when a drum is played ordinarily includes nothing similar to a back-rest, etc. that might obstruct a performer's movement since the performer usually moves rapidly or even violently while seated on the chair. Even when such a back-rest may be installed, it is positioned slightly toward the rear so as not to obstruct the movement of the performer. Its size is reduced to an extent such that it may not obstruct the performer's movement. As a result, the body weight of the performer is squarely placed on the drum chair.

DESCRIPTION OF A PRIOR ART EMBODIMENT

An example of a prior art chair is shown in FIGS. 10 and 11. The most frequently used drum chair 50 shown in FIG. 10 has a round seat plate 51 which is almost flat on its top side and the seat plate is supported by legs 55. The drum chair embodiment 60 shown in FIG. 11 includes a seat plate 61 of a saddle type with a narrowed front tip. A convex 62 or like upstanding at the rear of the seat plate is intended to promote a feeling of stability when a performer sits on the chair.

There are curved concave regions with a slightly inclined surface where the thighs of the performer rests. As shown, the seat surfaces where the femoral parts or thighs of the performer are placed are usually approximately flat.

Nevertheless, the buttocks 91 of the human body P are not flat, as shown in FIG. 9. When a performer is seated in a chair, in the skeletal structure, the hip bones 93 at the right and left protrude down at the pelvis and the coccyx 94 also protrudes down. The frame of the human body is surrounded by muscles and the buttocks 91 have a highly complicated curved surface.

As a consequence, the body regions below the hip bones 93 and the coccyx 94 are pressed more intensely by the seat surface of the chair than are the other parts of the buttocks 91 due to the weight of the performer seated in the chair. When a performance lasts a long time, e.g. an ordinary stage performance may last two to three hours and an ordinary recording session may take from seven to eight hours, the performer may become fatigued and may feel pain.

In addition, twin pedals have been used in recent drum performances, requiring a performer to operate two pedals with both legs. The performer may be operating the drum pedals with his heels raised from the floor, requiring that his weight be balanced by the seat surface alone and forcing him to adopt an unstable posture which would increase his fatigue.

SUMMARY OF THE INVENTION

The object of the present invention is to eliminate the problems described above.

The invention provides a chair structure with which the performer can perform pleasantly and in a stable posture, reducing fatigue or ache even during a long performance. The top side of the seat plate of the drum chair includes two concaves located below where the hip bones of the performer protrude down at both sides of the rear of the center of the seat plate, giving the seat plate an improved cushioning effect.

In addition, the seat plate of the drum chair may have a single concave below where the coccyx of the performer protrudes and behind the concaves below the hip bones, described above.

In another embodiment of a drum chair both the right and left sides of a bicycle seat shape seat plate are shaped as curved concaves capable of more comfortably holding the femoral regions of both legs of the performer. Alternatively, each curved concave region of the plate is a surface that becomes lower toward the edge.

Other object and features of the invention are described below with reference to the attached drawings.

BRIEF DESCRIPTION OF THE DRAWING(S)

DESCRIPTION OF PREFERRED EMBODIMENTS OF THE INVENTION

Figure 1:
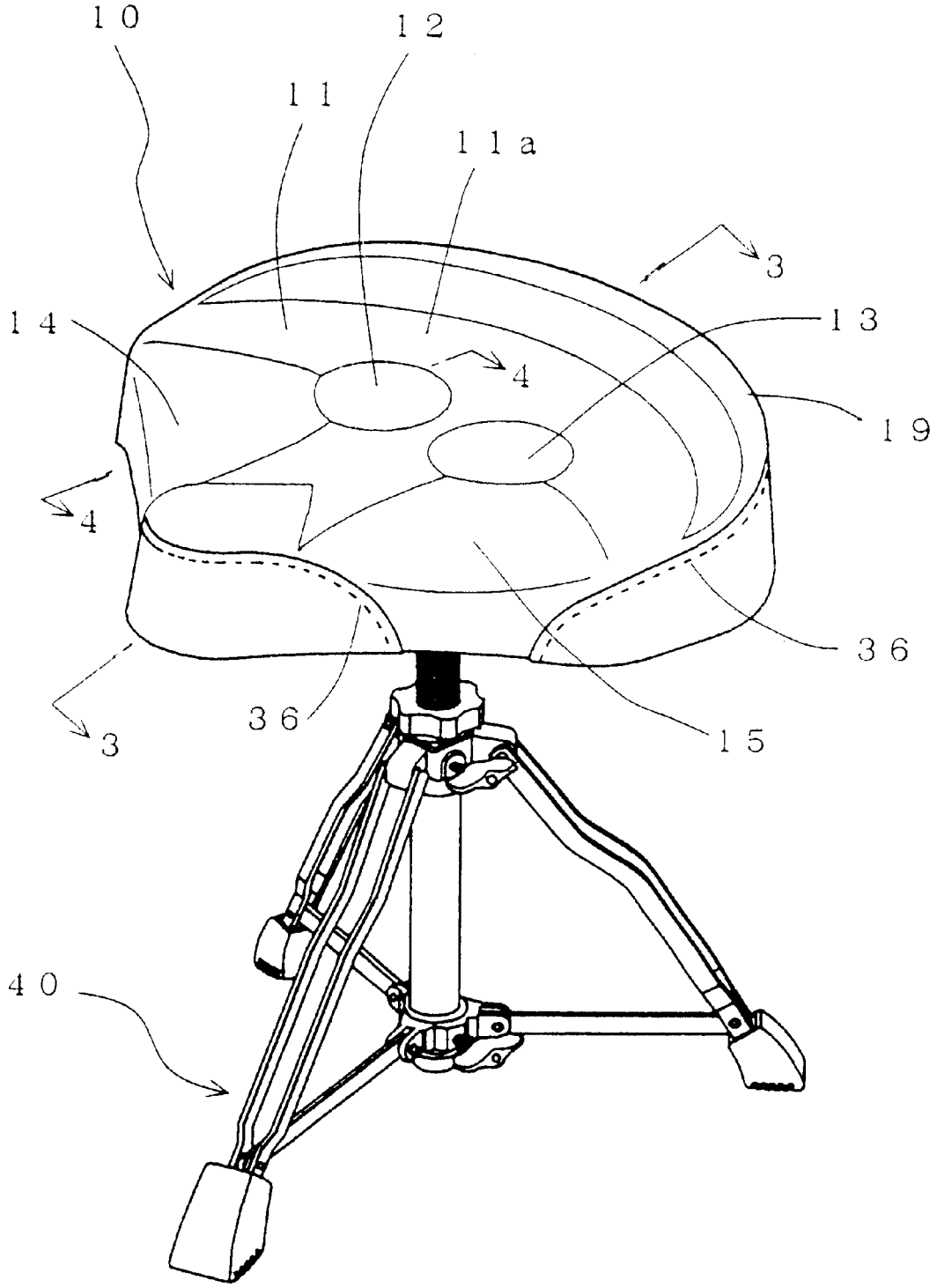
FIG. 1 is an oblique view of a drum chair of the invention.
Figure 2:
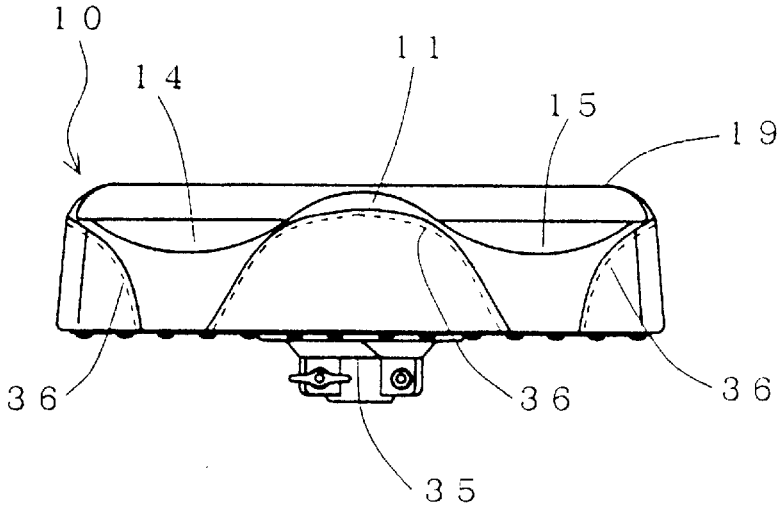
FIG. 2 is a front view of the seat plate of the chair in FIG. 1.

The chair 10 of FIG. 1 for use with a drum according to the invention includes a seat plate 11 which has a cushioning effect. The plate includes two separated concaves 12 and 13 defined into its top side seating surface and disposed below where the hip bones of the performer protrude downward at the right and at the left and to the rear of the center of the seat plate 11.

Figure 9:
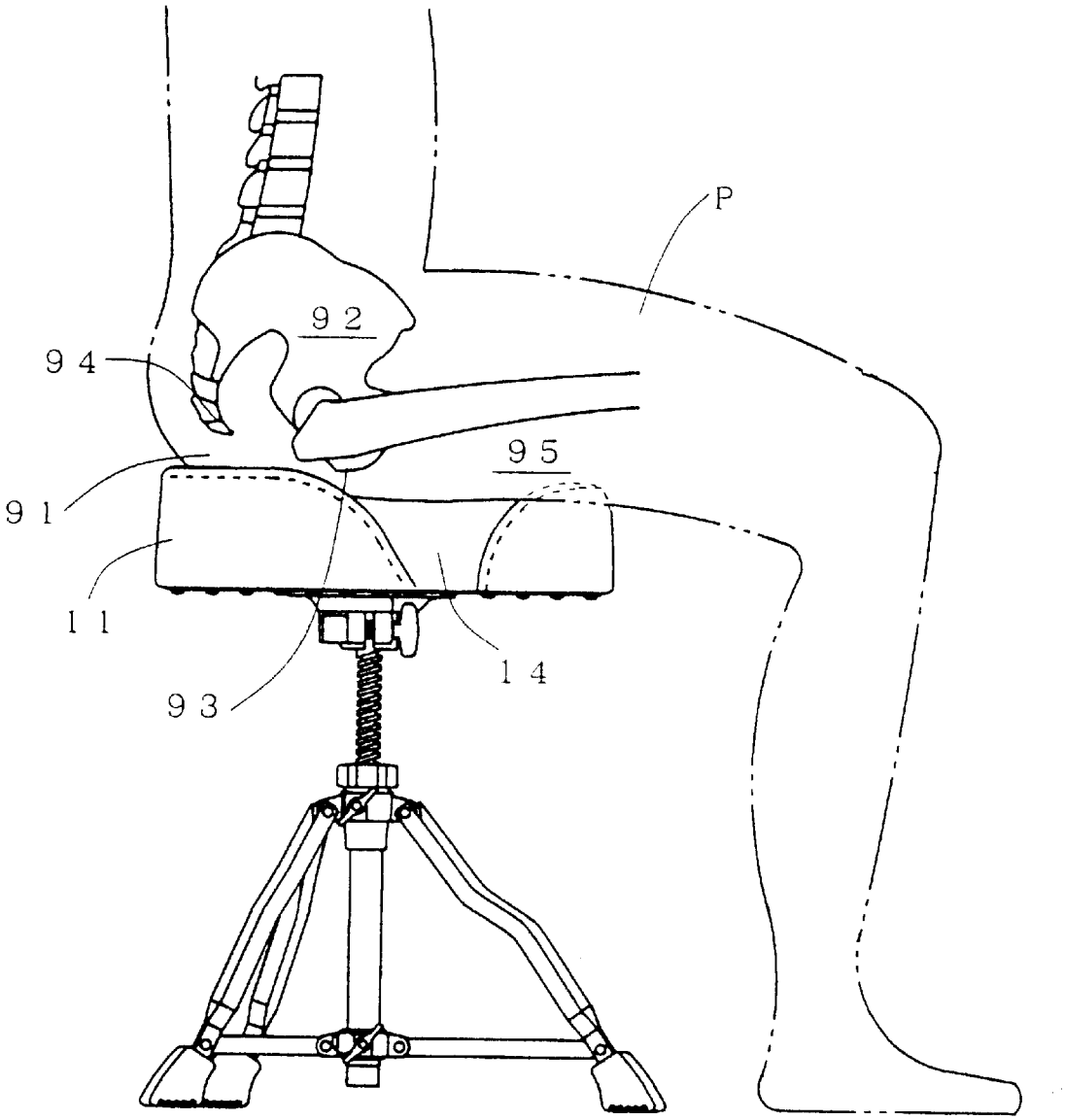
FIG. 9 is a side view showing the positional relationships of the skeletal structure of a seated performer.
Figure 10:
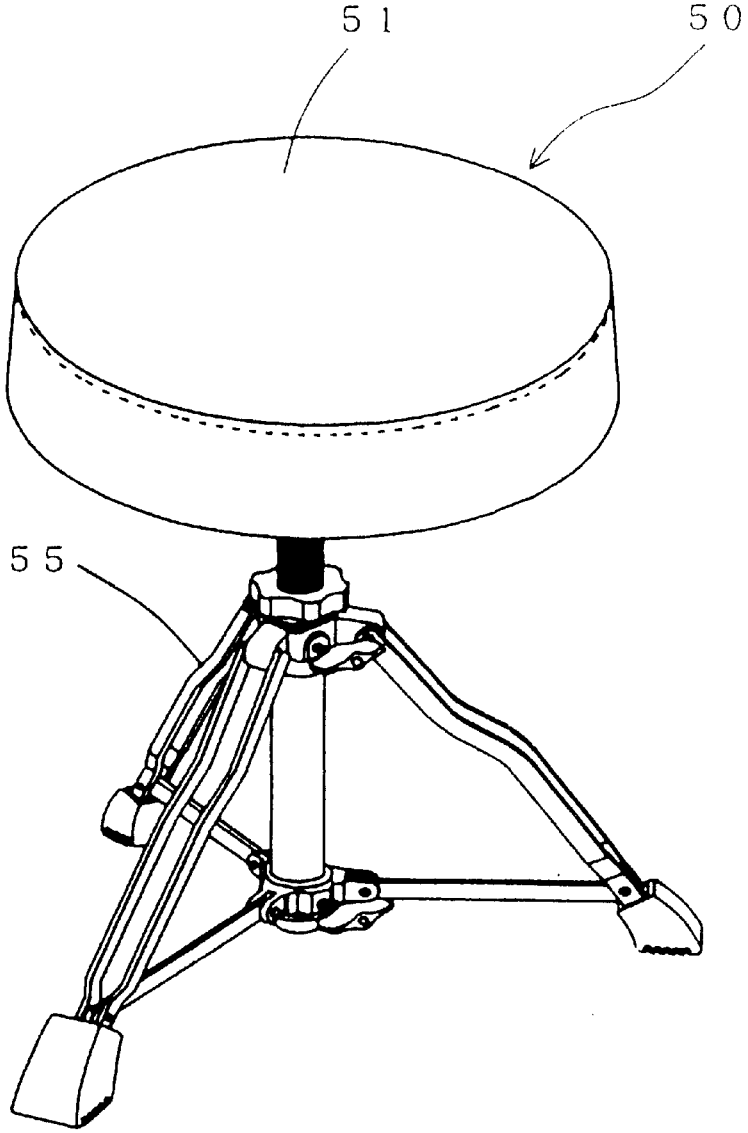
PRIOR ART FIG. 10
FIG. 10 is an oblique view of an embodiment of a prior art drum chair.
Figure 11:
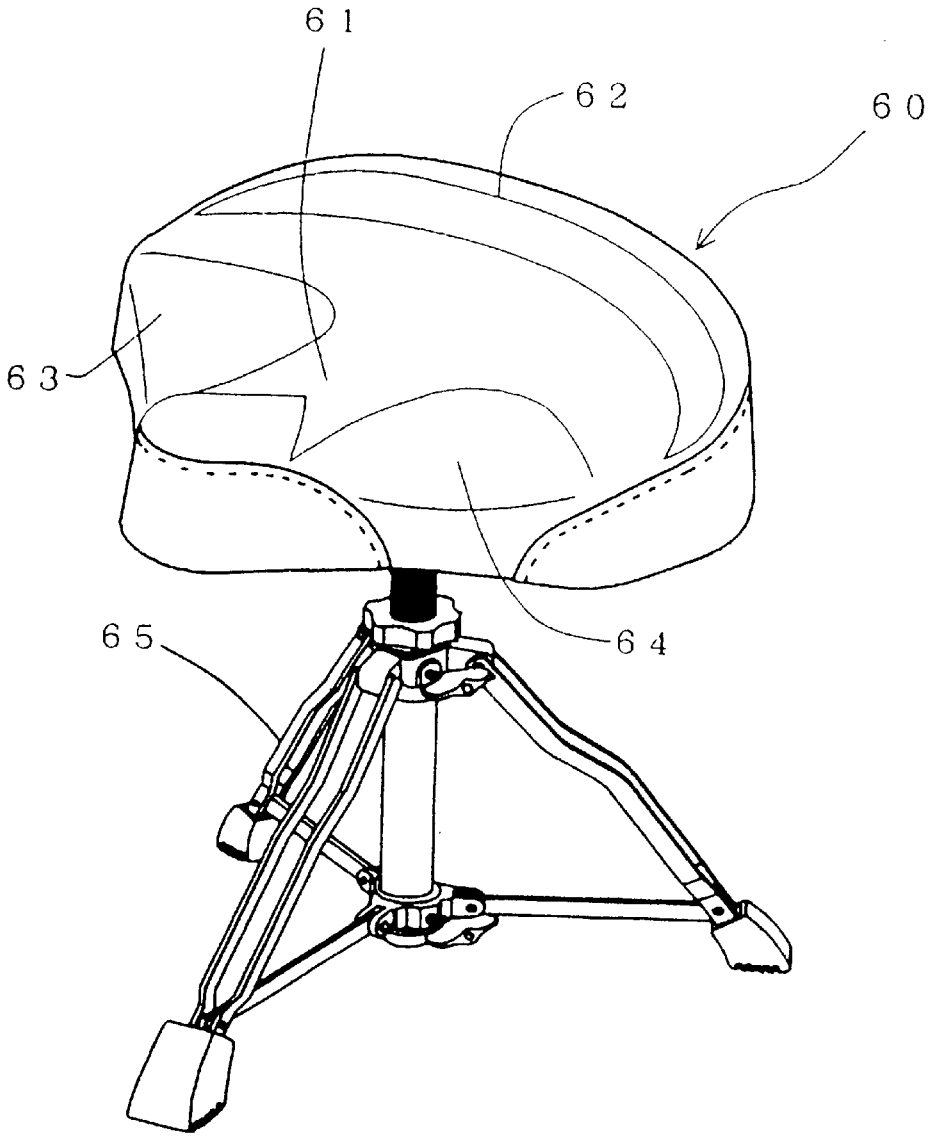
PRIOR ART FIG. 11
FIG. 11 is an oblique view of another embodiment of a prior art chair.

When a performer is seated in the chair 10, his hip bones 93 at both sides protrude downward because of the skeletal structure of the human body, as is shown in FIG. 9 and as described above. The buttock regions below the hip bones 93 are intensely pressed placing a heavy burden on them due to the weight of the performer, the seat surface of the chair and the movement of the seat, thereby causing an intense localized pressure. The performer will feel fatigue and pain because of the concentrated load against the regions below the hip bones especially when a performance lasts a long time. When the performer uses twin pedals, moreover, his posture becomes unstable and his fatigue will increase.

The invention avoids this concentration of the pressure. Fatigue and pain are mitigated and a stable user posture on the seat is maintained by providing the two concaves 12 and 13 below the hip bone regions at those parts of the seat plate both at the right and at the left toward the rear of the center of the seat plate 11 at locations corresponding to the normal regions below where hip bones 93 of the performer protrude.

Figure 3:
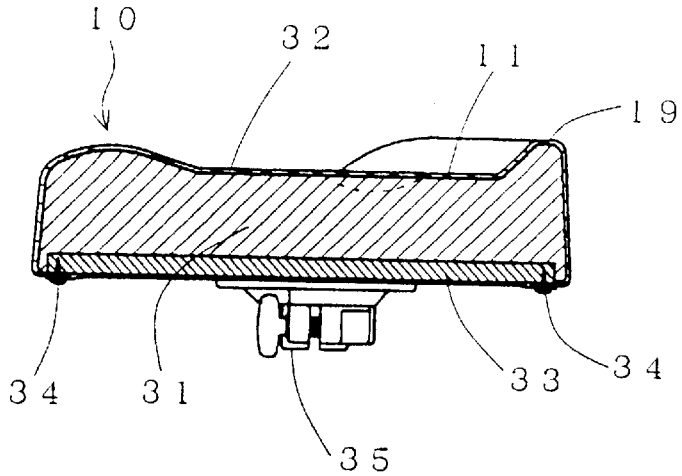
FIG. 3 is a cross section along line 3—3 of the seat plate shown in FIG. 1.
Figure 4:
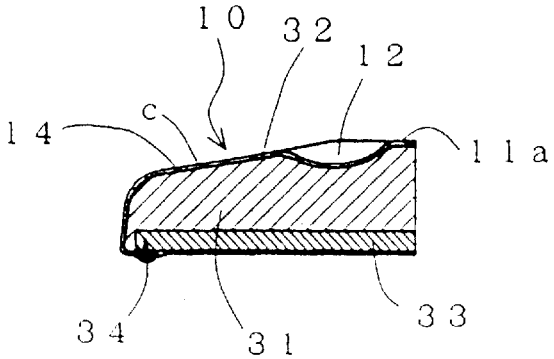
FIG. 4 is a cross section along line 4—4 of the seat plate shown in FIG. 1.

As is shown in the cross sections in FIGS. 3 and 4, the seat plate 11 includes a base material layer 31 for providing a cushioning effect, like urethane or sponge, inside the seat plate. The base layer 31 is surrounded by a synthetic leather or cloth surface 32 that is secured to the base layer by an adhesive agent and the surface 32 is also assembled together with a base plate 33 by pins 34. Installation assembly 35 receives the legs of the chair.

FIG. 1 shows curved concaves 14 and 15 at the femoral region described below and a convex 19 at the rear of the seat plate. There is a stitched portion 36 of the surface 32 and the leg assembly 40 is attached to the assembly 35.

Figure 8:
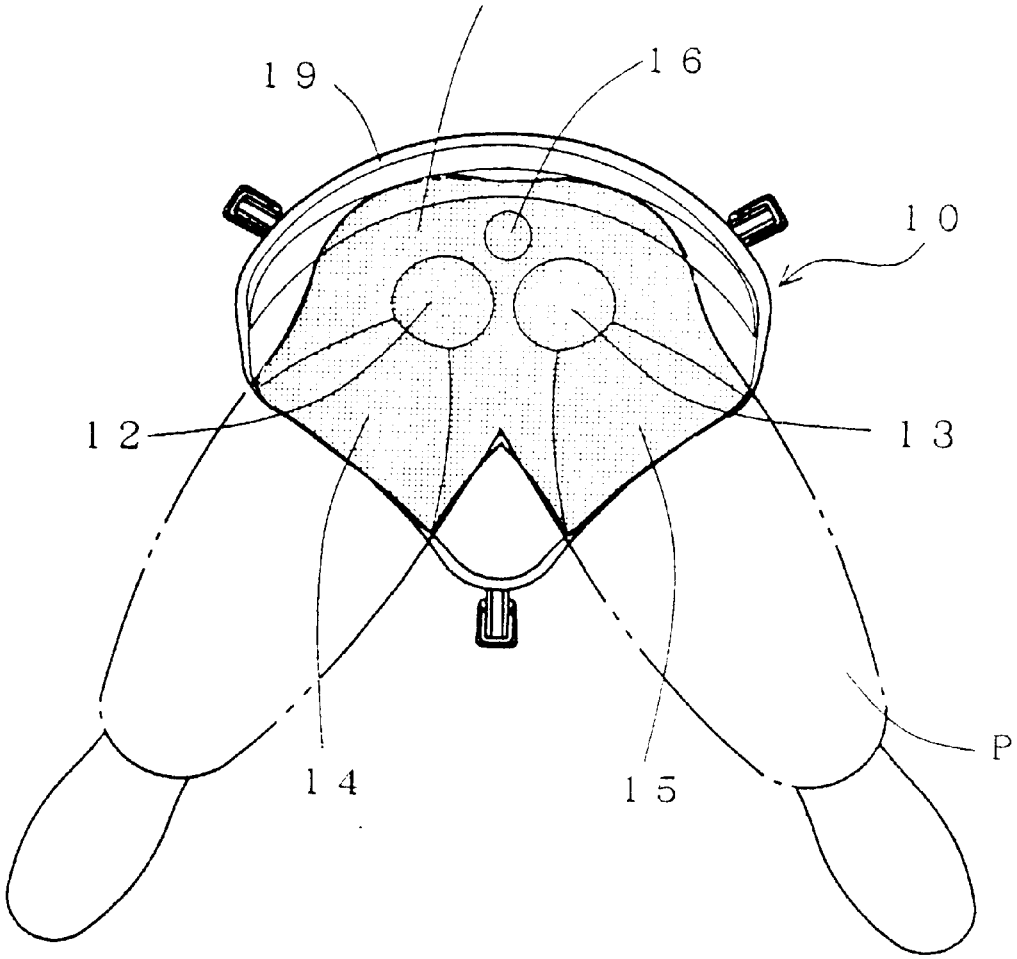
FIG. 8 shows a drum chair from above and indicated the state of a performer sitting.

The concaves 12 and 13 for the hip bones may be easily formed by creating the concaves in the surface of the base material 31 where the regions under the hip bones press at positions at the right and left and somewhat toward the rear of the center of the seat plate for a performer who sits in a correctly seated posture, as shown in FIG. 8. The positions of the concaves may be modified, depending upon the shape of the seat plate and/or the preference of the performer.

Each of the concaves 12 and 13 for the hip bones may be circular or oval in its peripheral shape and gradually depressed, like a crater or a dimple, as shown in FIG. 4, between two and three centimeters deep at most below the normal top surface 11*a* of the seat plate 11.

Figure 5:
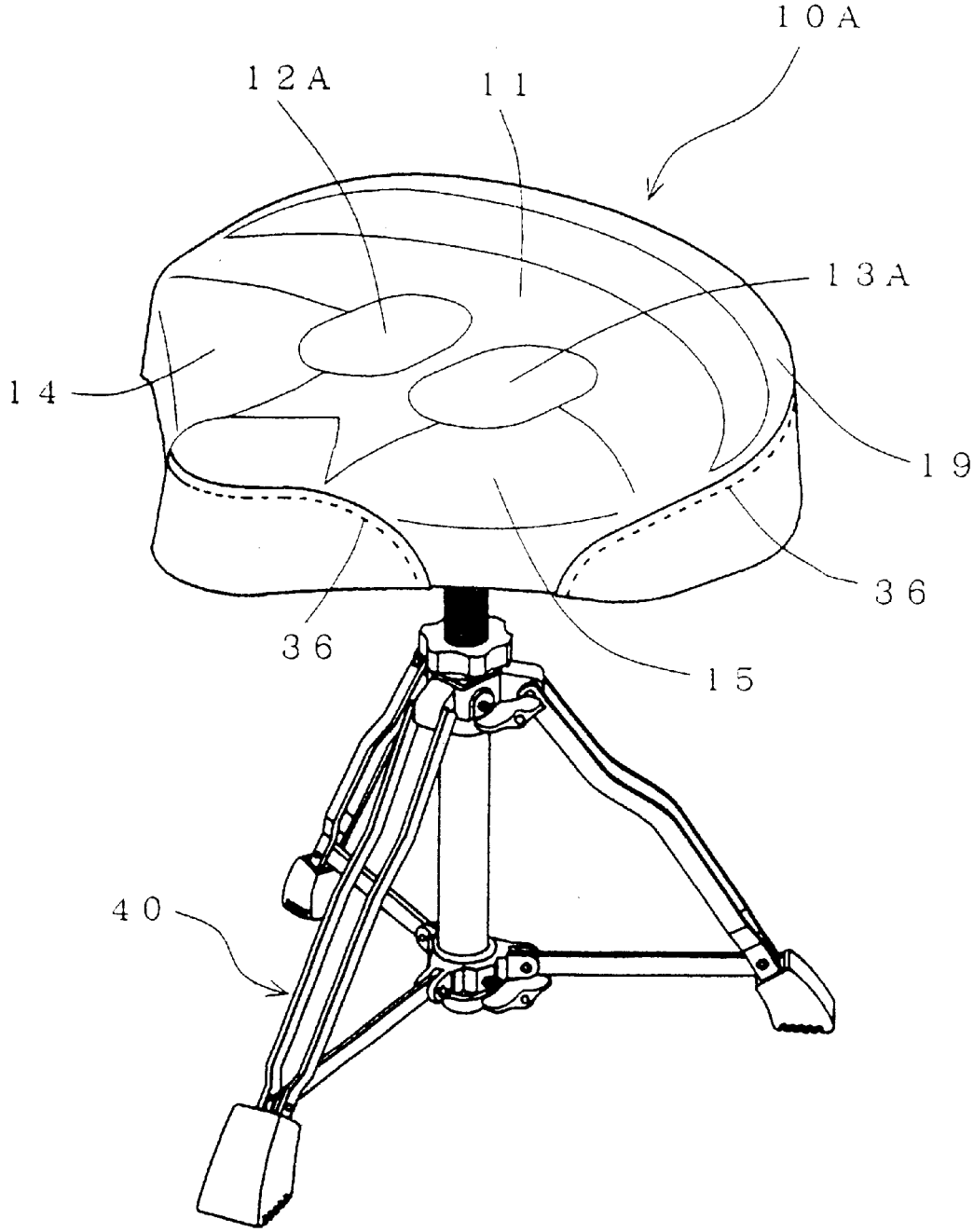
FIG. 5 is an oblique view of a second embodiment of a drum chair.

In the second embodiment of FIG. 5, the concaves 12A and 13A for the hip bones in the chair 10A are oval in their peripheral shape, with their longer axis extending in the front and rear direction of the seat plate 11. The oval shape and orientation enable coping with variations in the posture of the performer, who might tend to sit more toward either the front or the rear than the chair designer might expect.

Figure 6:
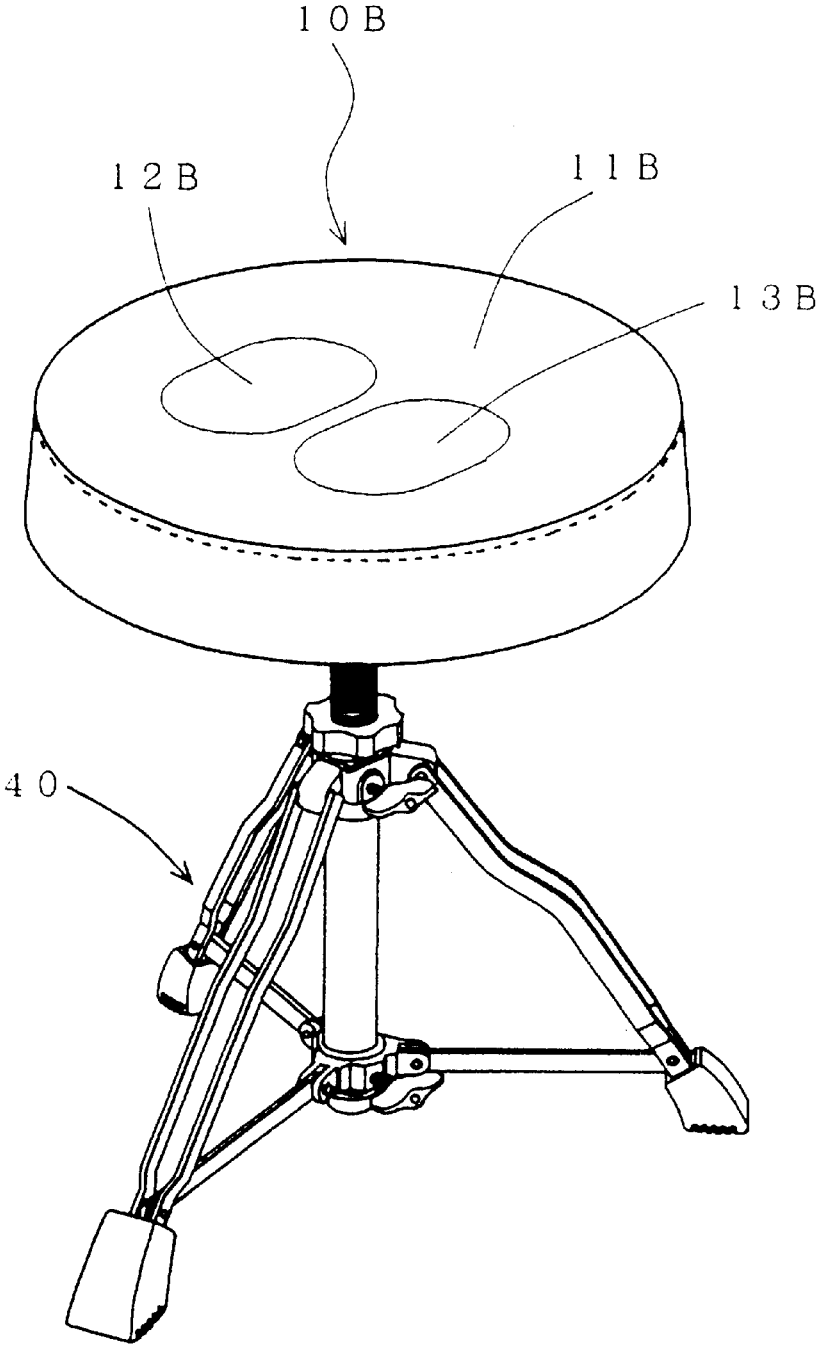
FIG. 6 is an oblique view of a third embodiment of a drum chair.

In the third embodiment 10B for the drum chair shown in FIG. 6, concaves 12B and 13B are also of an oval shape with the long axis forward and rearward. The concaves are provided in a seat plate 11B which is normally circular in shape as seen in the prior art.

Figure 7:
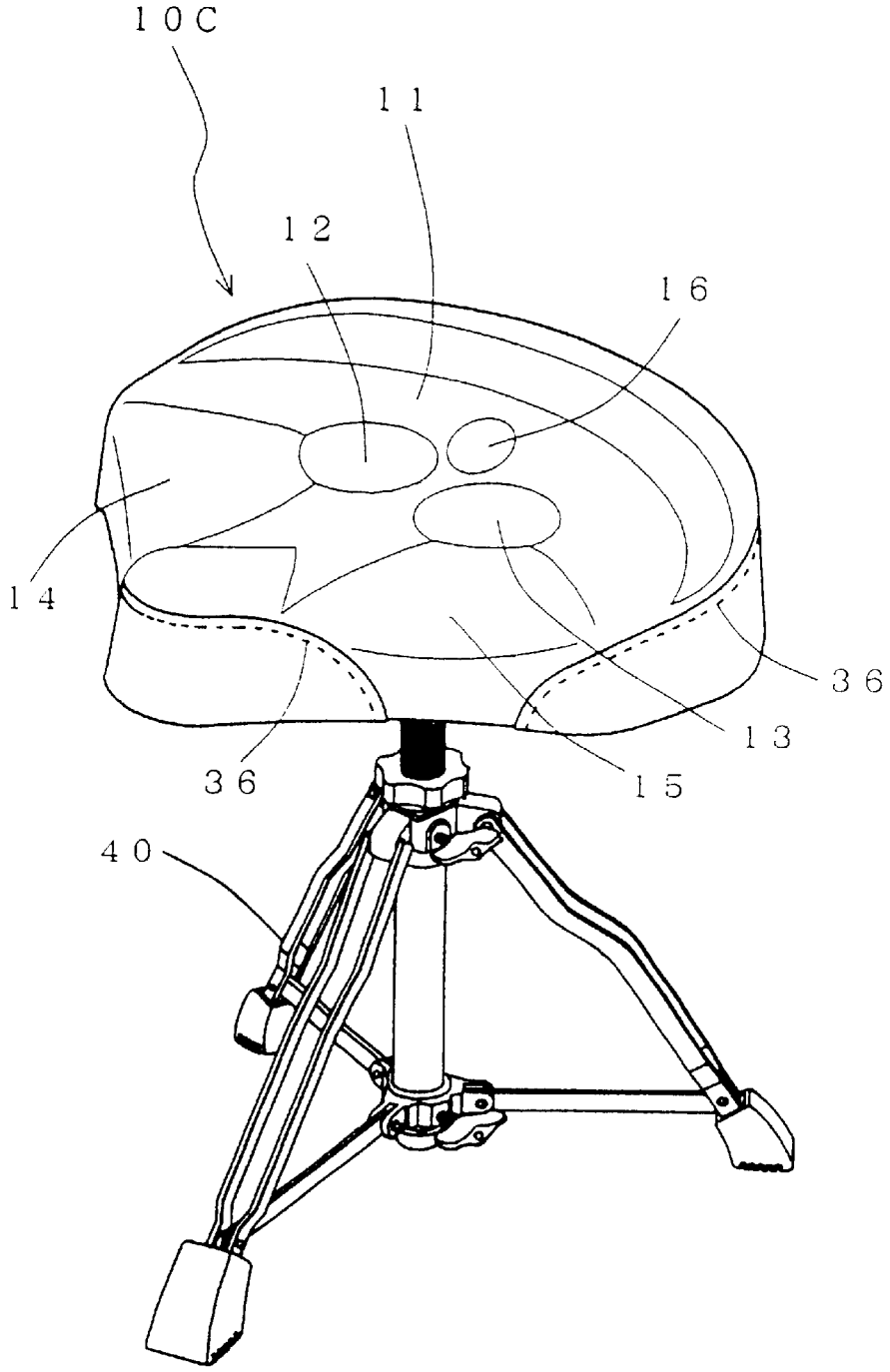
FIG. 7 is an oblique view of a fourth embodiment of a drum chair.

The FIGS. 6 and 7 reference numbers corresponding to those in FIG. 1 are for the same structure.

In the fourth embodiment of the chair 10C shown in FIG. 7, a single additional concave 16 for the region below the coccyx is placed below where the coccyx of the performer P (see coccyx 94 in FIG. 9) is situated, rearward of the concaves 12 and 13 toward the rear of the seat plate 11. A concave 16 below the coccyx enables mitigating fatigue and pain in the vicinity of the coccyx 94, helping the performer to maintain a satisfactory posture and concentrate on the performance.

In the embodiments of the invention shown in FIGS. 1, 5 and 7, the right and left sides at the front of the seat plate 11 are each formed in the shape of curved concaves 14 and 15 which are capable of holding the femoral part 95 of both legs of the performer. It is preferable for each of the curved concaves 14 and 15 to be formed as a surface C which becomes gradually lower toward the edge of the seat plate, as in FIG. 4.

Stitching 36 is so placed along the edges of the seat plate 11 to avoid the stitching being felt around the femoral parts. The stitching 36 preferably avoids the curved concaves 14 and 15.

The curved concaves 14 and 15 in the seat plate 11 for the femoral parts 95 of the performer P enables the weight of the performer to be dispersed over the holding surface that touches the femoral parts. This may mitigate the performer's fatigue while improving his performing posture.

The chair for a drum of the invention has two concaves below the hip bones provided toward the rear of the center of the cushioned seat plate and a single concave below the coccyx of the performer to the rear of the concaves below the hip bones. This enables the performer to perform pleasantly in a stable posture and mitigate fatigue and pain from performing, even when the performance extends over a long period of time.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A chair to receive a seated person having legs and buttocks, the legs having femoral thigh regions, the buttocks having hip bone regions, the chair comprising:

a seat plate having a cushioning effect to cushion the buttocks of the person, the seat plate having edge regions and top, front, rear, and lateral sides, the top side of the seat plate being provided with a first set of concave portions positioned to respectively receive the hip bone regions of the buttocks of the person, the top side of the seat plate being further provided with a second set of concave portions positioned forward of the first set of concave portions and toward the front side of the seat plate to respectively receive the femoral thigh regions of the legs of the person, the second set of concave portions extending slightly downwardly and outwardly toward the edge regions of the seat plate.

2. The chair of claim 1, further comprising a third concave formed in the top side of the seat plate and positioned below the coccyx of the person sitting on the seat plate and also located in the seat plate to the rear of the first set of concave portions for the hip bones.

3. The chair of claim 1, wherein the seat plate has right and left sides toward the front of the seat plate which are concavely curved for holding the femoral thigh regions of the legs of the performer sitting on the seat plate with the hip bones generally above the first set of concave portions provided therefor.

4. The chair of claim 3, wherein the seat plate has a bicycle seat shape and narrows toward the front at the right and left sides.

5. The chair of claim 1, wherein the first set of concave portions are round in shape.

6. The chair of claim 1, wherein the first set of concave portions are oval in shape, with the oval having a long axis extending in the forward and rearward direction of the seat plate.

7. The chair of claim 1, further comprising chair legs attached below the seat plate and on which the seat plate is supported.

8. The chair of claim 1, further comprising a convex peripheral region at the rear of the seat plate and behind the first and second concaves.

9. The chair of claim 1, wherein the first set of concave portions are positioned in the seat plate at locations below where the hip bones of a performer on a drum are likely positioned when the performer is sitting on the seat plate for playing a drum.

10. The chair of claim 1, wherein the seat plate has a bicycle seat shape and narrows toward the front at the right and left sides.

11. The chair of claim 1, wherein the seat plate is circular in shape.

12. The chair of claim 1, wherein the first set of concave portions are gradually depressed into the top side of the seat plate.

13. The chair of claim 1, wherein the second set of concave portions extend forward in the seat plate from the first set of concave portions and to the front of the seat plate.

14. The chair of claim 1, wherein concave portions of the first set of concave portions are separated from each other.

15. The chair of claim 1, wherein concave portions of the first set of concave portions are spaced entirely away from the front, rear and lateral sides of the seat plate.

* * * * *